US007155881B1

(12) United States Patent
McGuire et al.

(10) Patent No.: US 7,155,881 B1
(45) Date of Patent: Jan. 2, 2007

(54) METHOD OF SECURING VALUABLES IN A TOTE BAG ASSEMBLY

(76) Inventors: William D. McGuire, 3972 Hamilton Street, Port Coquitlam, BC (CA) V3B 3A7; Beverly J. McGuire, 3972 Hamilton Street, Port Coquitlam, BC (CA) V3B 3A7

( * ) Notice: Subject to any disclaimer, the term of this patent is extended or adjusted under 35 U.S.C. 154(b) by 33 days.

(21) Appl. No.: 11/171,017

(22) Filed: Jul. 1, 2005

(51) Int. Cl.
*B65B 51/04* (2006.01)
*B65B 5/00* (2006.01)

(52) U.S. Cl. ..... 53/416; 53/417; 53/449; 53/469; 53/480; 190/101; 70/64

(58) Field of Classification Search ..... 53/416, 53/417, 449, 469, 480; 70/63, 64; 190/101, 190/102; 220/603, 629; 383/37, 38, 109, 383/117, 119, 71, 92, 98
See application file for complete search history.

(56) References Cited

U.S. PATENT DOCUMENTS

| | | | | | |
|---|---|---|---|---|---|
| 2,166,860 | A | * | 7/1939 | Davis | 70/65 |
| 2,828,858 | A | * | 4/1958 | Tooke | 206/221 |
| 4,438,606 | A | * | 3/1984 | Chardon et al. | 52/79.1 |
| 4,557,377 | A | * | 12/1985 | Maloney | 206/219 |
| 4,924,893 | A | | 5/1990 | Furey | |
| 4,927,118 | A | * | 5/1990 | Pierorazio | 248/545 |
| 5,002,400 | A | * | 3/1991 | Strand | 383/8 |
| 5,143,108 | A | * | 9/1992 | Kenney | 135/16 |
| 5,187,823 | A | * | 2/1993 | Ferguson et al. | 5/417 |
| 5,199,361 | A | * | 4/1993 | Robinson | 109/51 |
| 5,288,150 | A | * | 2/1994 | Bearman | 383/38 |
| 5,289,915 | A | * | 3/1994 | Queen | 206/38 |
| 5,452,877 | A | | 9/1995 | Riffle et al. | |
| D387,555 | S | | 12/1997 | Miller | |
| RE35,814 | E | | 6/1998 | Olson | |
| 5,774,912 | A | * | 7/1998 | Dominique | 5/419 |
| 5,843,556 | A | | 12/1998 | Levas | |
| 6,026,662 | A | * | 2/2000 | Schlipper | 70/18 |
| 6,077,587 | A | * | 6/2000 | Potok | 428/99 |
| 6,113,268 | A | * | 9/2000 | Thompson | 383/40 |
| 6,371,645 | B1 | | 4/2002 | Rusert et al. | |
| 6,581,424 | B1 | * | 6/2003 | Oliver | 70/164 |
| 7,069,753 | B1 | * | 7/2006 | Schlipper | 70/18 |

* cited by examiner

*Primary Examiner*—Stephen F Gerrity

(57) ABSTRACT

A valuable securing tote bag assembly and method includes a housing that has a bottom wall and a peripheral wall that is attached to and extends upwardly from the bottom wall. Each of the bottom and peripheral walls is flexible. The peripheral wall has an upper edge that forms a plurality of outer flaps. An inner flap is attached to an inner surface of the peripheral wall and divides the housing into an upper portion and a lower portion. A fastener is removably extendable through the outer flaps so that the outer flaps are secured together to define a closed position of the housing. The lower portion of the housing is filled with sand and valuables are positioned in the upper portion of the housing. The outer flaps are then secured together with the fastener.

8 Claims, 2 Drawing Sheets

METHOD OF SECURING VALUABLES IN A TOTE BAG ASSEMBLY

BACKGROUND OF THE INVENTION

1. Field of the Invention

The present invention relates to tote bag devices and more particularly pertains to a new tote bag device for holding valuables on a beach in a secured manner.

2. Description of the Prior Art

The use of tote bag devices is known in the prior art. U.S. Pat. No. 5,843,556 describes a device that is adapted for use as a beach tote bag and may also be used for covering a chair. Another type of tote bag device is U.S. Pat. No. 5,452,877 which includes a beach bag adapted for being filled with a weighting material, such as sand, so that the beach bag may be used as an anchor for an umbrella. Another such device is found in U.S. Pat. No. 4,924,893 which again includes an anchoring system which may be secured to a beach umbrella to ensure that umbrella is not blown away. Still yet another tote bag is found in U.S. Pat. No. 6,371,645.

While these devices fulfill their respective, particular objectives and requirements, the need remains for a device that can be used as a conventional beach tote bag for carrying beach towels and other articles. The device should also be used for holding valuables in a secured manner in which the device is not easily removed from the beach. This will allow persons using the device to leave their valuables on the beach while they enjoy the water.

SUMMARY OF THE INVENTION

The present invention meets the needs presented above by generally comprising providing a housing that includes a bottom wall and a peripheral wall that is attached to and extends upwardly from the bottom wall. Each of the bottom and peripheral walls is flexible. The peripheral wall has an upper edge that forms a plurality of outer flaps. An inner flap is attached to an inner surface of the peripheral wall and divides the housing into an upper portion and a lower portion. A fastener is removably extendable through the outer flaps so that the outer flaps are secured together to define a closed position of the housing. The lower portion of the housing is filled with sand and valuables are positioned in the upper portion of the housing. The outer flaps are then secured together with the fastener.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
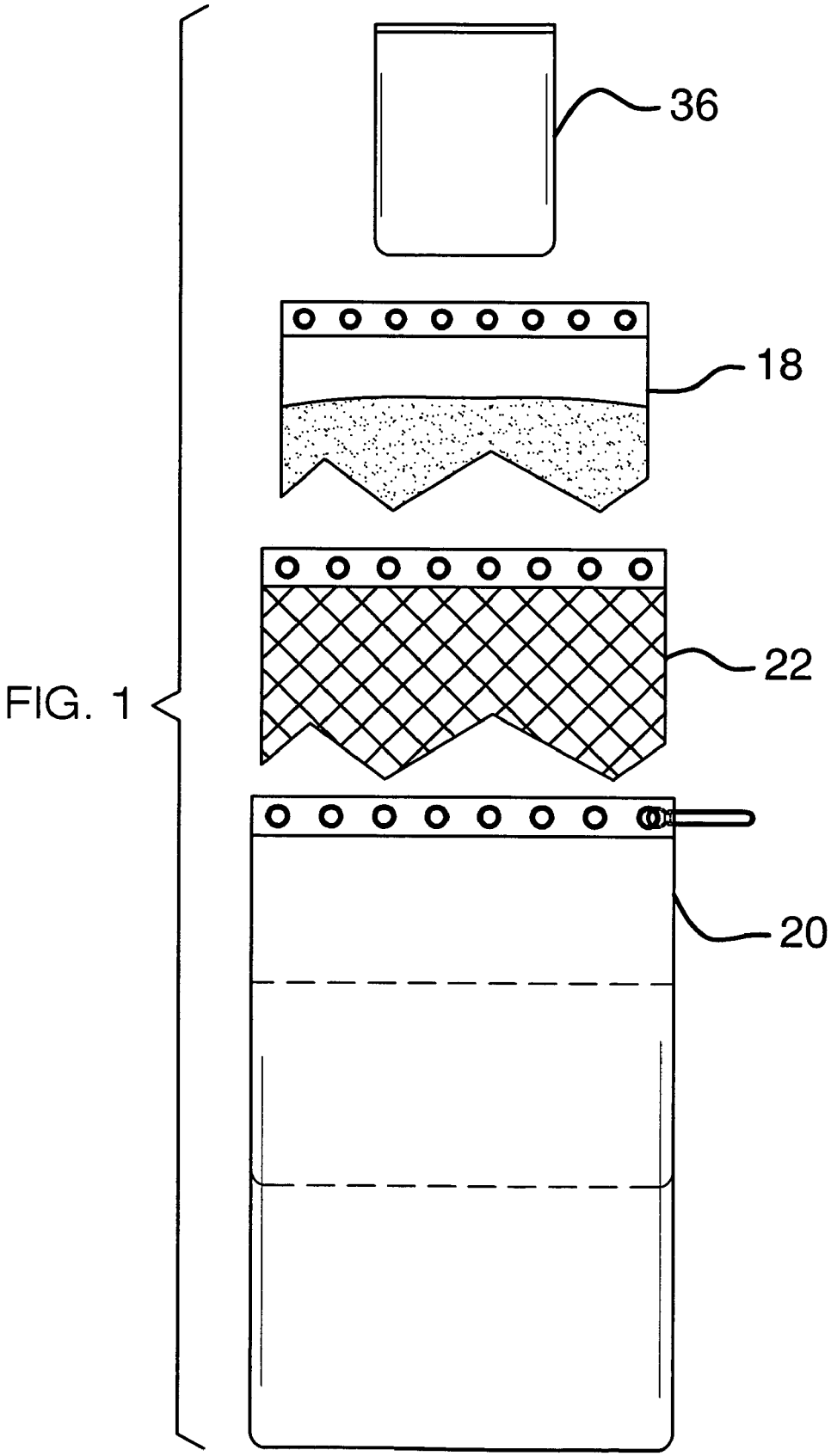
FIG. 1 is a front expanded view of a valuable securing tote bag assembly and method according to the present invention.
Figure 2:
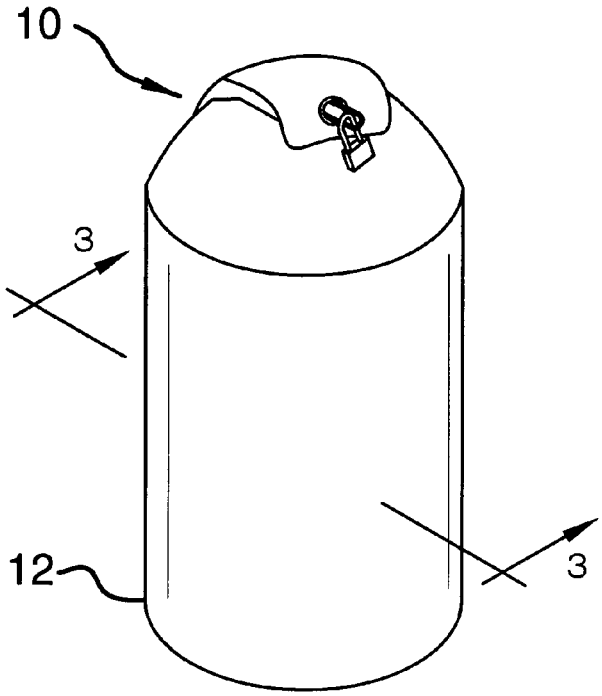
FIG. 2 is a perspective view of the present invention.
Figure 4:
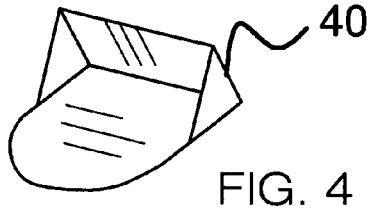
FIG. 4 is a perspective view of a scoop of the present invention.
Figure 5:
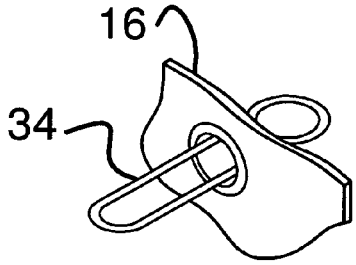
FIG. 5 is an enlarged perspective view of a fastener loop of the present invention.
Figure 3:
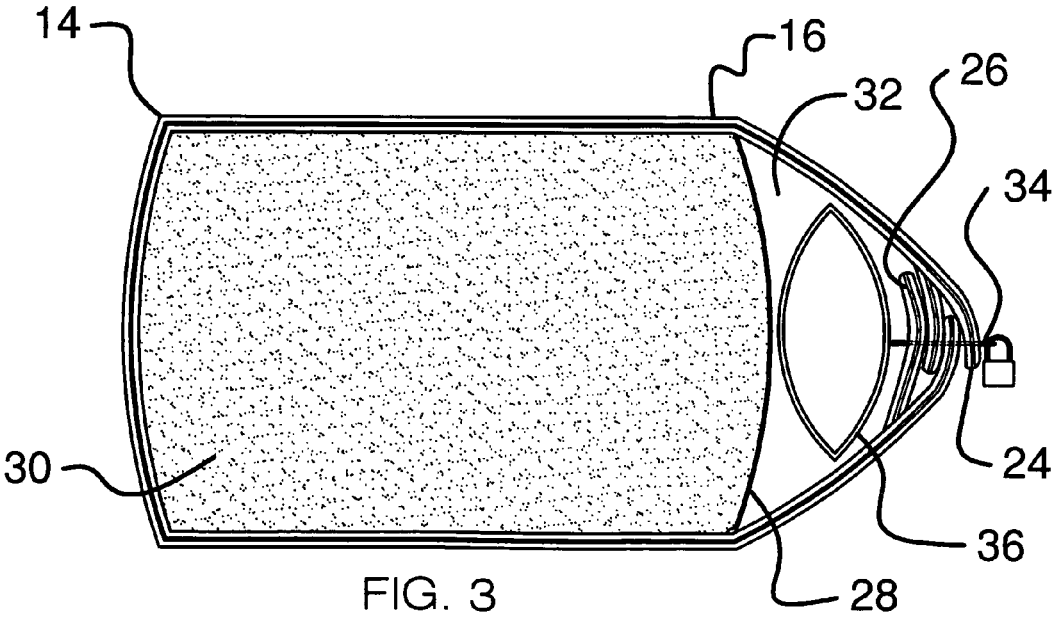
FIG. 3 is a cross-sectional view taken along line 3—3 of FIG. 2 of the present invention.

With reference now to the drawings, and in particular to FIGS. 1 through 5 thereof, a new tote bag device embodying the principles and concepts of the present invention and generally designated by the reference numeral 10 will be described.

As best illustrated in FIGS. 1 through 5, the valuable securing tote bag assembly and method 10 generally comprises providing a housing 12 that includes a bottom wall 14 and a peripheral wall 16 that is attached to and extends upwardly from the bottom wall 14. Each of the bottom 14 and peripheral 16 walls are flexible and each of the bottom 14 and peripheral 16 walls includes an inner layer 18, an outer layer 20 and a middle layer 22 positioned between the outer 20 and inner 18 layers. The inner 18 and outer 20 layers each comprise a cloth material. The cloth material may comprise either a natural or synthetic material. The middle layer 22 comprises a steel mesh material. The steel mesh material makes the bottom 14 and peripheral 16 walls resistant to cutting by a knife. The peripheral wall 16 has an upper edge 24 forming a plurality of outer flaps 26 when the upper edge 24 is folded over itself. The bottom wall 14 has an outer perimeter measurement generally between 45 inches and 70 inches. The peripheral wall 16 has a height generally between 15 inches and 25 inches. An inner flap 28 is attached to inner surface of the peripheral wall 16 and is adapted for dividing the housing 12 into an upper portion 32 and a lower portion 30. The lower portion 30 preferably has a height equal to at least 12 inches.

A fastener 34 is provided which is removably extendable through the outer flaps 26 so that the outer flaps 26 are secured together to define a closed position of the housing. The fastener 34 includes a loop removably extendable through the outer flaps 26 and a conventional padlock, which is attached to the loop so that the loop is not removable from the outer flaps 26.

A flexible container 36 is also provided. The flexible container 36 has a smaller interior volume than the housing 12 and defines a pouch for holding small valuables such as money and jewelry.

In use, the lower portion 30 of the housing 12 is filled with sand. A scoop 40 may be provided for aiding a person in filling the housing 12 with sand. The inner flap 28 is laid down over the sand. A person places their valuables in the container 36 and the container 36 is then positioned in the upper portion 32 of the housing 12. The outer flaps 26 are then secured together with the fastener 34. The sand in the lower portion 30 makes the housing 12 virtually impossible to lift, particularly in an easy manner, while the steel mesh middle layer 22 prevents someone from cutting the housing 12 open to access the valuables stored therein. A person may thus leave their valuables on the beach while they enjoy the water. When a person wishes to leave the beach, the fastener 34 is removed and the sand taken out of the housing 12. The housing 12 may then be used for holding beach articles such as towels and sunscreen. The assembly and method 10 preferably includes a scoop 40 to aid a person in scooping sand into the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method of storing valuables comprising the steps of:

providing a housing including a bottom wall and a peripheral wall being attached to and extending upwardly from said bottom wall, each of said bottom and peripheral walls being flexible, said peripheral wall having an upper edge forming a plurality of outer flaps;

providing an inner flap being attached to an inner surface of said peripheral wall and being adapted for dividing said housing into an upper portion and a lower portion;

providing a fastener, said fastener being removably extendable through said outer flaps such that said outer flaps are secured together to define a closed position of said housing;

filling said lower portion of said housing with sand;

positioning valuables in said upper portion of said housing; and securing said outer flaps together with said fastener.

2. The method according to claim 1, wherein each of said bottom and peripheral walls includes an inner layer, an outer layer and a middle layer positioned between said outer and inner layers, each of said inner and outer layers comprising a cloth material, said middle layer comprising a steel mesh material.

3. The method according to claim 2, further providing a flexible container, said flexible container having a smaller interior volume than said housing, said valuables being positioned in said container before said valuables are positioned in said upper portion.

4. The method according to claim 1, wherein said bottom wall has an outer perimeter measurement generally between 45 inches and 70 inches and said peripheral wall has a height generally between 15 inches and 25 inches.

5. The method according to claim 4, wherein said lower portion has a height equal to at least 12 inches.

6. The method according to claim 1, wherein said lower portion has a height equal to at least 12 inches.

7. The method according to claim 1, further providing a flexible container, said flexible container having a smaller interior volume than said housing, said valuables being positioned in said container before said valuables are positioned in said upper portion.

8. A method of storing valuables comprising the steps of:

providing a housing including a bottom wall and a peripheral wall being attached to and extending upwardly from said bottom wall, each of said bottom and peripheral walls being flexible, each of said bottom and peripheral walls including an inner layer, an outer layer and a middle layer positioned between said outer and inner layers, each of said inner and outer layers comprising a cloth material, said middle layer comprising a steel mesh material, said peripheral wall having an upper edge forming a plurality of outer flaps, said bottom wall having an outer perimeter measurement generally between 45 inches and 70 inches, said peripheral wall having a height generally between 15 inches and 25 inches;

providing an inner flap being attached to an inner surface of said peripheral wall and being adapted for dividing said housing into an upper portion and a lower portion, said lower portion having a height equal to at least 12 inches;

providing a fastener, said fastener being removably extendable through said outer flaps such that said outer flaps are secured together to define a closed position of said housing;

providing a flexible container, said flexible container having a smaller interior volume than said housing;

filling said lower portion of said housing with sand;

positioning valuables in said container;

positioning said container in said upper portion of said housing; and securing said outer flaps together with said fastener.

* * * * *